US010021990B2

(12) United States Patent
Patronaggio

(10) Patent No.: US 10,021,990 B2
(45) Date of Patent: Jul. 17, 2018

(54) COOLER WITH FOLD OUT BED

(71) Applicant: Cory Patronaggio, Davie, FL (US)

(72) Inventor: Cory Patronaggio, Davie, FL (US)

( * ) Notice: Subject to any disclaimer, the term of this patent is extended or adjusted under 35 U.S.C. 154(b) by 0 days.

(21) Appl. No.: 15/419,198

(22) Filed: Jan. 30, 2017

(65) Prior Publication Data

US 2017/0231400 A1 Aug. 17, 2017

Related U.S. Application Data

(60) Provisional application No. 62/294,534, filed on Feb. 12, 2016.

(51) Int. Cl.

| | |
|---|---|
| ***A45C 11/20*** | (2006.01) |
| ***A47C 19/22*** | (2006.01) |
| ***A47C 17/70*** | (2006.01) |
| ***A47C 17/80*** | (2006.01) |
| ***F25D 23/12*** | (2006.01) |

(52) U.S. Cl.

CPC ..... *A47C 19/22* (2013.01); *A47C 17/705* (2013.01); *A47C 17/80* (2013.01); *F25D 23/12* (2013.01)

(58) Field of Classification Search

CPC ..... A47C 19/22; A47C 17/80; A47C 17/705; B65D 81/3813; B65D 51/24; B65D 43/163; F25D 23/12; F25D 3/08; F25D 2400/16; F25D 2303/081

USPC ..... 206/541, 545, 549; 220/592.16, 592.17, 220/915.1, 915.2; 224/156, 923; 190/1, 190/2, 12 R, 12 A; 5/2.1, 3

See application file for complete search history.

(56) References Cited

U.S. PATENT DOCUMENTS

| | | | | | |
|---|---|---|---|---|---|
| 1,005,709 | A * | 10/1911 | Jackson | A45C 9/00 | 190/2 |
| 2,351,610 | A * | 6/1944 | Hamberg | A47B 17/033 | 312/194 |
| 3,823,992 | A * | 7/1974 | Corbett | A47B 77/02 | 312/201 |
| 6,174,026 | B1 * | 1/2001 | Wise | A47B 85/00 | 108/17 |
| 6,328,179 | B1 * | 12/2001 | Conrado | A45C 5/14 | 108/14 |
| 6,497,441 | B1 * | 12/2002 | Mahmood | B60N 2/2854 | 224/400 |

(Continued)

*Primary Examiner* — Jacob K Ackun
*Assistant Examiner* — Jenine Pagan
(74) *Attorney, Agent, or Firm* — Mayback & Hoffman, P.A.; Gregory L. Mayback

(57) ABSTRACT

A convertible cooler comprises a cooler body, a lid having a top surface and a rear connector part, a bed extension having an adjoining edge and a sleeping surface, a bed extension connector pivotally connecting the adjoining edge to the rear connector part to rotate the bed extension between a stowed position, in which the bed extension rests flat upon the top surface of the lid, and an extended position, in which the sleeping surface of the bed extension is substantially coplanar with the top surface of the lid, and a leg assembly connected to the bed extension and adjustably supporting the bed extension above ground at a level that places the sleeping surface substantially coplanar with the top surface of the lid when in the extended position. The lid top surface and the sleeping surface of the bed extension are sized to permit a person to sleep thereon.

16 Claims, 8 Drawing Sheets

(56) References Cited

U.S. PATENT DOCUMENTS

| | | | | |
|---|---|---|---|---|
| 6,588,821 | B2 * | 7/2003 | Worrell | B60N 2/26 224/275 |
| 7,451,709 | B2 * | 11/2008 | Swartfager | F25D 23/12 108/14 |
| 7,909,148 | B1 * | 3/2011 | Miller | A45C 9/00 190/11 |
| 8,875,854 | B2 * | 11/2014 | Zuckerman | A45C 5/03 190/2 |
| 9,476,638 | B1 * | 10/2016 | Tyler | F25D 31/005 |
| 2011/0315695 | A1 * | 12/2011 | Fuqua | B65D 81/3813 220/592.16 |

* cited by examiner

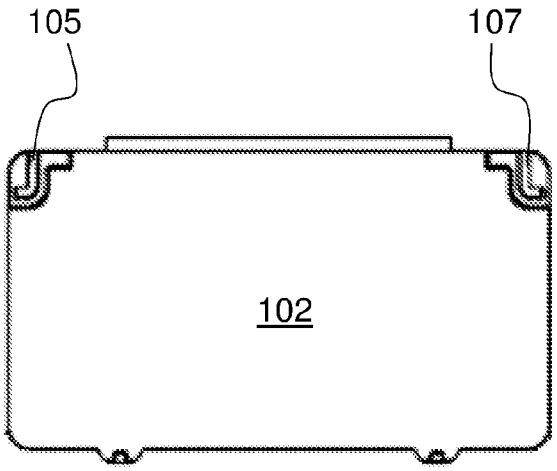
FIG. 15
FIG. 16
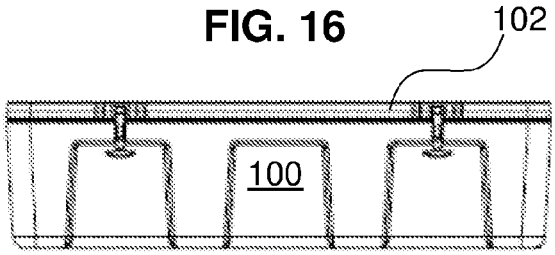
FIG. 17
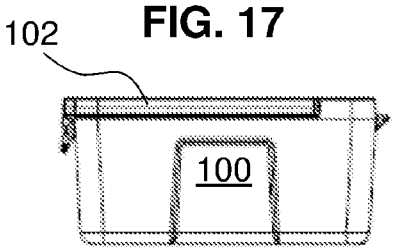
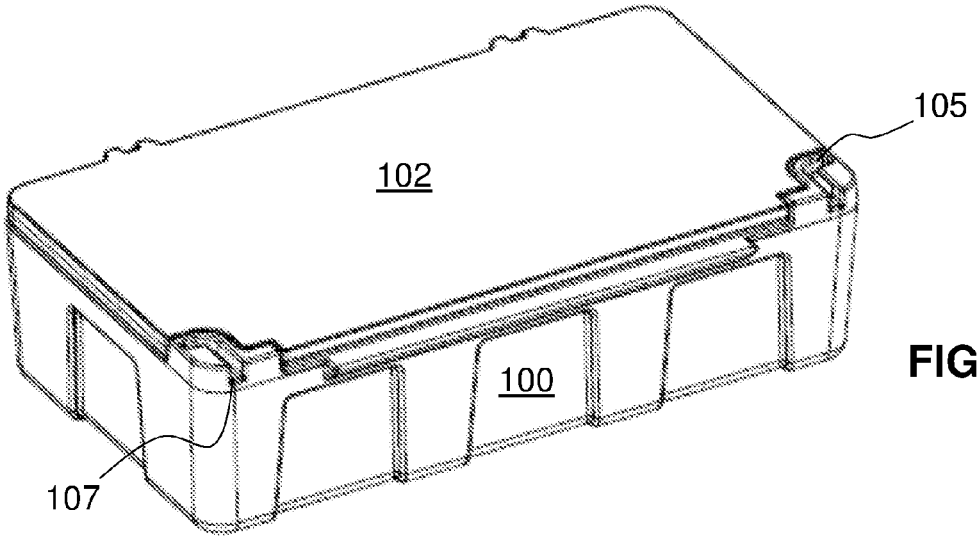
FIG. 18

COOLER WITH FOLD OUT BED

CROSS-REFERENCE TO RELATED APPLICATIONS

This application claims the priority, under 35 U.S.C. § 119, of U.S. Provisional Patent Application No. 62/294,534, filed Feb. 12, 2016; the prior application is herewith incorporated by reference herein in its entirety.

STATEMENT REGARDING FEDERALLY SPONSORED RESEARCH OR DEVELOPMENT

Not Applicable

FIELD OF THE INVENTION

The present systems and methods lies in the field of products that convert from one use into at least one other different use. The present disclosure relates to a cooler with a fold out bed.

BACKGROUND OF THE INVENTION

When traveling, space is at a premium. This is especially true when the person also wishing to bring a bed for sleeping. For traveling in vehicles, the amount of space that is available for a bed is based upon the dimensions of the vehicle. If the vehicle is a van, the interior compartment defines the maximum size of the sleeping area. If the vehicle is a pick-up truck, the bed defines the maximum size of the sleeping area. Food also must be accounted for when traveling and takes up space as well. Most food that requires protection or temperature control is stored in coolers. Both coolers and beds take up a significant amount of space for vehicles and the presence of a cooler can, in many instances, entirely preclude the use of a bed inside a van or in a bed of a pick-up truck.

Thus, a need exists to overcome the problems with the prior art systems, designs, and processes as discussed above.

SUMMARY OF THE INVENTION

The systems and methods described provide a cooler with a fold-out bed that overcomes the hereinafore-mentioned disadvantages of the heretofore-known devices and methods of this general type and that provide such features with the ability to convert the cooler from a standard sized cooler into a bed platform and back again.

The top surface of the cooler acts as one part of the bed platform and a removable (or integral) bed extension attaches to and/or folds out from the cooler to form a level, multi-part bed platform surface. Handle slots are present in each side of the cooler for carrying. Where the bed extension is removable, one or more additional handle slots are present for separately carrying the bed extension.

One exemplary embodiment of the cooler that converts into the bed platform has the following dimensions: approximately 47 inches (approximately 119.4 centimeters) wide, approximately 26 inches (approximately 66.04 centimeters) deep, and approximately 12 inches (approximately 30.48 centimeters) high.

When used with a van, the cooler can be placed into the back area when the back seats are made to recess into the floor of the vehicle. The fold out bed extension is unfolded to extend from the top of the cooler and form a horizontal bed surface that extends parallel to and above the floor of the van's back area. Leg assemblies are removably attached to or extended from the distal most end of the bed extension to keep the distal most end supported evenly with the top surface of the cooler, thereby creating an open space below the bed extension for storage. Sheets, a mattress, and/or pillows can be placed on top of the surface of the bed extension for sleeping.

When used within a bed of a pick-up truck, the cooler can be placed into the bed and the fold out bed extension is unfolded to extend from the top of the cooler and form a horizontal bed surface that extends parallel to and above the floor of the bed. Leg assemblies are removably attached to or extended from the distal most end of the bed extension to keep the distal most end supported evenly with the top surface of the cooler, thereby creating an open space below the bed extension for storage. Sheets, a mattress, and/or pillows can be placed on top of the surface of the bed extension for sleeping. If the bed has an open top, a tent or other protective sheet can be placed above the bed for protection from the elements.

The cooler can also be placed on the ground at a park, campsite, or even inside of a tent.

In an exemplary embodiment, the foldout bed platform comprises three bed panels, the top of the cooler itself serving as the first panel and the bed extension having two adjoining panels that are able to be folded for storage and opened for use as the bed surface. One end of the two panels is attached to the top of the cooler so that the three upper surfaces form a substantially single sleeping plane. One exemplary embodiment for connecting the bed extension to the cooler includes a pin and slot connection. The slots are on the top side at the back of the cooler and the pins protrude out of each end of the connecting panel of the bed extension. In a removable embodiment, the adjoining panel of the bed extension can be removed from the top of the cooler. When the bed extension is attached to the cooler, the two panels are unfolded and, while unfolded, the adjoining panel on the end connected to the cooler is supported by a molded ledge, or lip, that protrudes from the back of the cooler. The third panel (i.e., the second panel of the bed extension that is on the side opposite the cooler) has two pins that can be moved into and/or against the second panel and these pins prevent the two panels from being folded until disassembled. At the outer edge of the third panel there are two areas at each end where a supporting leg can be attached to support that end of the bed platform. In an exemplary embodiment, the supporting leg assemblies attach using a C-clamp or bracket type device, for example, having a hand knob on the bottom side for tightening or loosening and for removal of the leg assemblies. The leg assemblies can slide horizontally along the edge of the second panel to find a desirable location on the ground (e.g., on the surface of the van floor) before being tightened into place. The leg assemblies are also telescoping and can be adjusted up or down to accommodate any undulation of the ground on which the leg rests.

The front of the cooler is where the cooler is opened for access of the internal compartment by the user. The cooler can be opened whether or not the bed extension is attached to the cooler. When the cooler is placed in the back of a van, for example, the cooler is placed at the back of the van with the front of the cooler facing out the back door.

With the foregoing and other objects in view, there is provided, a convertible cooler with fold-out sleeping surface comprises a cooler body, a thermally insulated cooler lid, a bed extension, a bed extension, and at least one leg assembly. The cooler body has thermally insulating walls shaped to define an interior storage compartment with an upper opening and a rear wall having an upper rear portion. The cooler lid is pivotally connected to the upper rear portion such that, when closed upon the upper opening, the cooler lid substantially seals the upper opening from the environment so that items placed within the interior storage compartment are thermally insulated from the environment. The cooler lid has a top surface, a rear side, and a lid connector disposed at least one of at the rear side and at the top surface. The bed extension has an adjoining edge, side edges, a distal edge, and a sleeping surface. The bed extension connector pivotally connects the adjoining edge of the bed extension to the cooler lid adjacent the rear side to rotate the bed extension between a stowed position, in which the bed extension rests flat upon the top surface of the cooler lid, and an extended position, in which the sleeping surface of the bed extension is substantially coplanar with the top surface of the cooler lid, the top surface of the cooler lid and the sleeping surface of the bed extension being sized to permit a person to sleep thereon. The at least one leg assembly is connected to at least one of the side edges and the distal edge and adjustably supports the distal edge of the bed extension above ground at a level that places the sleeping surface of the bed extension substantially coplanar with the top surface of the cooler lid when in the extended position.

In general, a cooler is able to thermally insulate the interior contents from the atmosphere and keep it close to a desired temperature. To do this adequately, the cooler lid, which opens, must be well sealed when closed. Accordingly, the cooler lid is said herein to substantially seal the upper opening from the environment so that items placed within the interior storage compartment are thermally insulated from the environment. As used herein, "substantially seals" means that the seal between the lid and the cooler body is a water-tight seal while the lid is closed securely.

In accordance with another feature, the lid connector is disposed at the rear side and at the top surface of the cooler lid.

In accordance with a further feature, the lid connector comprises a slot open at a portion of the rear side and at a portion of the top surface and extending from the rear side into a central portion of the cooler lid.

In accordance with an added feature, the lid connector comprises a curved slot open at a portion of the rear side and at a portion of the top surface and extending orthogonally from the rear side along a first part into a central portion of the cooler lid for a given distance and then curving along a second part at an angle to the first part.

In accordance with an additional feature, the lid connector comprises a hooked slot open at a portion of the rear side and at a portion of the top surface and extending orthogonally from the rear side along a first part into a central portion of the cooler lid for a given distance and then extending along a second part at an angle to the first part.

In accordance with yet another feature, the slot defines opposing bosses therein projecting into the slot.

In accordance with yet a further feature, the bed extension connector comprises a hook pin shaped to mate with the curved slot and, when mated therewith, removably securing the bed extension to the cooler lid.

In accordance with yet an added feature, the bed extension connector comprises a hook pin shaped to mate with the hooked slot and, when mated therewith, removably securing the bed extension to the cooler lid.

In accordance with yet an additional feature, the bed extension comprises an adjoining panel having the adjoining edge and a first upper surface and a distal panel pivotally connected to the adjoining panel and having the side edges, the distal edge, and a second upper surface, and the top surface of the cooler lid and the first and second upper surfaces together form the sleeping surface when the bed extension is moved into the extended position.

In accordance with again another feature, the at least one leg assembly comprises a bracket configured to clamp upon the bed extension adjacent the distal edge and be removably connected thereto and a telescoping leg connected to the bracket and telescopically movable to extend and retract away from and towards the bracket.

In accordance with again a further feature, the at least one leg assembly is two leg assemblies.

In accordance with again an added feature, the pivotable connection by the bed extension connector of the cooler lid to the adjoining edge of the bed extension is removable so that the bed extension may be selectively separated from the cooler lid by a user and the at least one leg assembly is removably connected to at least one of the side edges and the distal edge so that the at least one leg assembly may be selectively separated from the bed extension by a user.

With the objects in view, there is also provided a convertible cooler with fold-out sleeping surface comprises a thermally insulating cooler having an interior storage compartment and a pivoting lid that, when closed, substantially seals the interior from the environment so that items placed within the interior storage compartment are thermally insulated from the environment, the lid having a top surface and a rear connector part, a bed extension having an adjoining edge, and a sleeping surface, a bed extension connector pivotally connecting the adjoining edge of the bed extension to the rear connector part to rotate the bed extension between a stowed position, in which the bed extension rests flat upon the top surface of the lid and an extended position, in which the sleeping surface of the bed extension is substantially coplanar with the top surface of the lid, the top surface of the lid and the sleeping surface of the bed extension being sized to permit a person to sleep thereon, and at least one leg assembly connected to the bed extension and adjustably supporting the bed extension above ground at a level that places the sleeping surface of the bed extension substantially coplanar with the top surface of the lid when in the extended position.

In accordance with again an additional feature, the lid has a rear side and the rear connector part comprises a hooked slot open at the rear side and at the top surface and extending inwards from the rear side towards a central portion of the lid for a given distance and then extending at an angle thereto and the bed extension connector comprises a hook pin shaped to mate with the hooked slot and, when mated therewith, removably securing the bed extension to the lid.

In accordance with still another feature, the hooked slot defines opposing bosses therein projecting into the hooked slot.

In accordance with still a further feature, the bed extension comprises an adjoining panel having the adjoining edge and a first upper surface and a distal panel pivotally connected to the adjoining panel and having a second upper surface, and the top surface of the lid and the first and second upper surfaces together form the sleeping surface when the bed extension is moved into the extended position.

In accordance with still an added feature, the at least one leg assembly comprises a bracket configured to clamp upon the bed extension and be removably connected thereto and a telescoping leg connected to the bracket and telescopically movable to extend and retract away from and towards the bracket.

In accordance with still an additional feature, the at least one leg assembly is two leg assemblies.

In accordance with a concomitant feature, the pivotable connection by the bed extension connector of the lid to the adjoining edge of the bed extension is removable so that the bed extension may be selectively separated from the lid by a user and the at least one leg assembly is removably connected to the bed extension so that the at least one leg assembly may be selectively separated from the bed extension by a user.

Although the systems and methods are illustrated and described herein as embodied in a cooler with a fold-out bed, it is, nevertheless, not intended to be limited to the details shown because various modifications and structural changes may be made therein without departing from the spirit of the invention and within the scope and range of equivalents of the claims. Additionally, well-known elements of exemplary embodiments will not be described in detail or will be omitted so as not to obscure the relevant details of the systems and methods.

Additional advantages and other features characteristic of the systems and methods will be set forth in the detailed description that follows and may be apparent from the detailed description or may be learned by practice of exemplary embodiments. Still other advantages of the systems and methods may be realized by any of the instrumentalities, methods, or combinations particularly pointed out in the claims.

Other features that are considered as characteristic for the systems and methods are set forth in the appended claims. As required, detailed embodiments of the systems and methods are disclosed herein; however, it is to be understood that the disclosed embodiments are merely exemplary of the systems and methods, which can be embodied in various forms. Therefore, specific structural and functional details disclosed herein are not to be interpreted as limiting, but merely as a basis for the claims and as a representative basis for teaching one of ordinary skill in the art to variously employ the systems and methods in virtually any appropriately detailed structure. Further, the terms and phrases used herein are not intended to be limiting; but rather, to provide an understandable description of the systems and methods. While the specification concludes with claims defining the systems and methods of the invention that are regarded as novel, it is believed that the systems and methods will be better understood from a consideration of the following description in conjunction with the drawing figures, in which like reference numerals are carried forward.

BRIEF DESCRIPTION OF THE DRAWINGS

The accompanying figures, where like reference numerals refer to identical or functionally similar elements throughout the separate views, which are not true to scale, and which, together with the detailed description below, are incorporated in and form part of the specification, serve to illustrate further various embodiments and to explain various principles and advantages all in accordance with the systems and methods. Advantages of embodiments of the systems and methods will be apparent from the following detailed description of the exemplary embodiments thereof, which description should be considered in conjunction with the accompanying drawings in which:

FIG. 15 is a top plan view of the cooler of FIG. 1;

FIG. 16 is a front side elevational view of the cooler of FIG. 15;

FIG. 17 is a right side elevational view of the cooler of FIG. 15;

FIG. 18 is a perspective view of the cooler of FIG. 15 viewed from the rear;

DETAILED DESCRIPTION OF THE EMBODIMENTS

Figure 1:
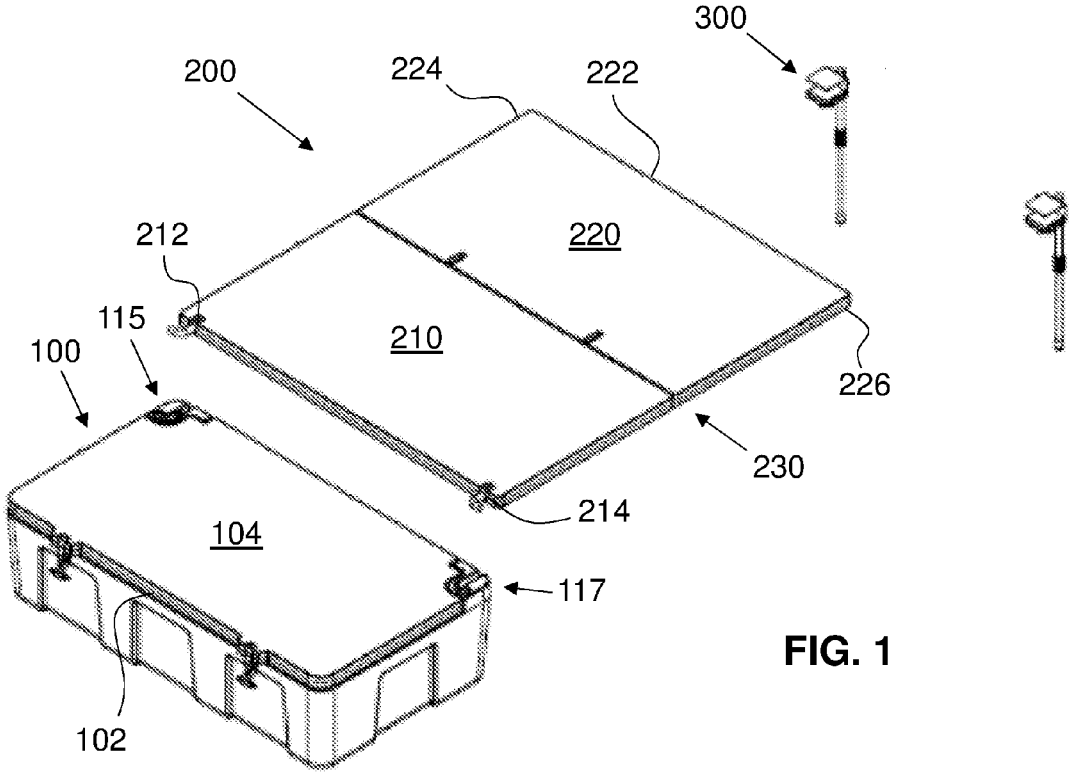
FIG. 1 is an exploded, perspective view of an exemplary embodiment of a cooler with a fold-out bed extension and leg assemblies.

As required, detailed embodiments of the systems and methods are disclosed herein; however, it is to be understood that the disclosed embodiments are merely exemplary of the systems and methods, which can be embodied in various forms. Therefore, specific structural and functional details disclosed herein are not to be interpreted as limiting, but merely as a basis for the claims and as a representative basis for teaching one skilled in the art to variously employ the systems and methods in virtually any appropriately detailed structure. Further, the terms and phrases used herein are not intended to be limiting; but rather, to provide an understandable description of the systems and methods. While the specification concludes with claims defining the features of the systems and methods that are regarded as novel, it is believed that the systems and methods will be better understood from a consideration of the following description in conjunction with the drawing figures, in which like reference numerals are carried forward.

In the following detailed description, reference is made to the accompanying drawings which form a part hereof, and in which are shown by way of illustration embodiments that may be practiced. It is to be understood that other embodiments may be utilized and structural or logical changes may be made without departing from the scope. Therefore, the following detailed description is not to be taken in a limiting sense, and the scope of embodiments is defined by the appended claims and their equivalents.

Alternate embodiments may be devised without departing from the spirit or the scope of the invention. Additionally, well-known elements of exemplary embodiments of the systems and methods will not be described in detail or will be omitted so as not to obscure the relevant details of the systems and methods.

Before the systems and methods are disclosed and described, it is to be understood that the terminology used herein is for the purpose of describing particular embodiments only and is not intended to be limiting. The terms "comprises," "comprising," or any other variation thereof are intended to cover a non-exclusive inclusion, such that a process, method, article, or apparatus that comprises a list of elements does not include only those elements but may include other elements not expressly listed or inherent to such process, method, article, or apparatus. An element proceeded by "comprises . . . a" does not, without more constraints, preclude the existence of additional identical elements in the process, method, article, or apparatus that comprises the element. The terms "including" and/or "having," as used herein, are defined as comprising (i.e., open language). The terms "a" or "an", as used herein, are defined as one or more than one. The term "plurality," as used herein, is defined as two or more than two. The term "another," as used herein, is defined as at least a second or more. The description may use the terms "embodiment" or "embodiments," which may each refer to one or more of the same or different embodiments.

The terms "coupled" and "connected," along with their derivatives, may be used. It should be understood that these terms are not intended as synonyms for each other. Rather, in particular embodiments, "connected" may be used to indicate that two or more elements are in direct physical or electrical contact with each other. "Coupled" may mean that two or more elements are in direct physical or electrical contact (e.g., directly coupled). However, "coupled" may also mean that two or more elements are not in direct contact with each other, but yet still cooperate or interact with each other (e.g., indirectly coupled).

For the purposes of the description, a phrase in the form "A/B" or in the form "A and/or B" or in the form "at least one of A and B" means (A), (B), or (A and B), where A and B are variables indicating a particular object or attribute. When used, this phrase is intended to and is hereby defined as a choice of A or B or both A and B, which is similar to the phrase "and/or". Where more than two variables are present in such a phrase, this phrase is hereby defined as including only one of the variables, any one of the variables, any combination of any of the variables, and all of the variables, for example, a phrase in the form "at least one of A, B, and C" means (A), (B), (C), (A and B), (A and C), (B and C), or (A, B and C).

Relational terms such as first and second, top and bottom, and the like may be used solely to distinguish one entity or action from another entity or action without necessarily requiring or implying any actual such relationship or order between such entities or actions. The description may use perspective-based descriptions such as up/down, back/front, and top/bottom. Such descriptions are merely used to facilitate the discussion and are not intended to restrict the application of disclosed embodiments. Various operations may be described as multiple discrete operations in turn, in a manner that may be helpful in understanding embodiments; however, the order of description should not be construed to imply that these operations are order dependent.

As used herein, the term "about" or "approximately" applies to all numeric values, whether or not explicitly indicated. These terms generally refer to a range of numbers that one of skill in the art would consider equivalent to the recited values (i.e., having the same function or result). In many instances these terms may include numbers that are rounded to the nearest significant figure.

Herein various embodiments of the systems and methods are described. In many of the different embodiments, features are similar. Therefore, to avoid redundancy, repetitive description of these similar features may not be made in some circumstances. It shall be understood, however, that description of a first-appearing feature applies to the later described similar feature and each respective description, therefore, is to be incorporated therein without such repetition.

Figure 2:
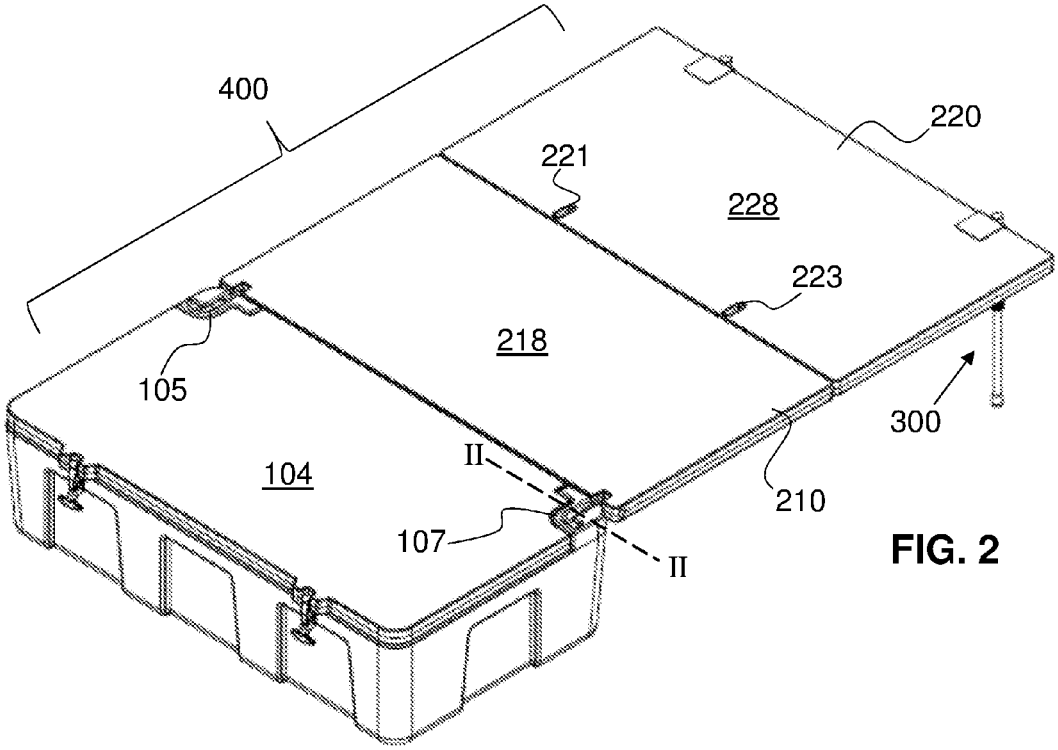
FIG. 2 is a perspective view of the cooler of FIG. 1 in an assembled state with the bed extension attached to an upper portion of the cooler by hook pins in a fixed open position and with the leg assemblies attached at a distal edge.

Described now are exemplary embodiments. Referring now to the figures of the drawings in detail and first, particularly to FIG. 1, there is shown a first exemplary embodiment of a cooler having a removable fold-out bed platform. The cooler 100 is shown with connection areas 115, 117 on the rear of the top surface 104 of the lid 102. Separated from the cooler 100 is a bed extension 200 having an adjoining panel 210 with connectors 212, 214 and a distal panel 220 pivotally connected to the adjoining panel 210 by a hinge 230 at an intermediate location between the panels 210, 220. A set of leg assemblies 300 are provided to removably attach to a distal portion of the distal panel 220, either at the distal edge 222 or at the side edges 224, 226. FIG. 1 depicts the bed extension 200 separated from the cooler 100 and the leg assemblies 300 separated from the bed extension 200. The system is shown in FIG. 2 in the full open and locked orientation with a sleeping surface 400 comprising the two respective upper surfaces 218, 228 of the adjoining panel 210 and the distal panel 220 and the top surface 104. In this orientation, the user can sleep directly upon the sleeping surface 400 or can place a mattress or any other bedding material thereon.

Figure 3:
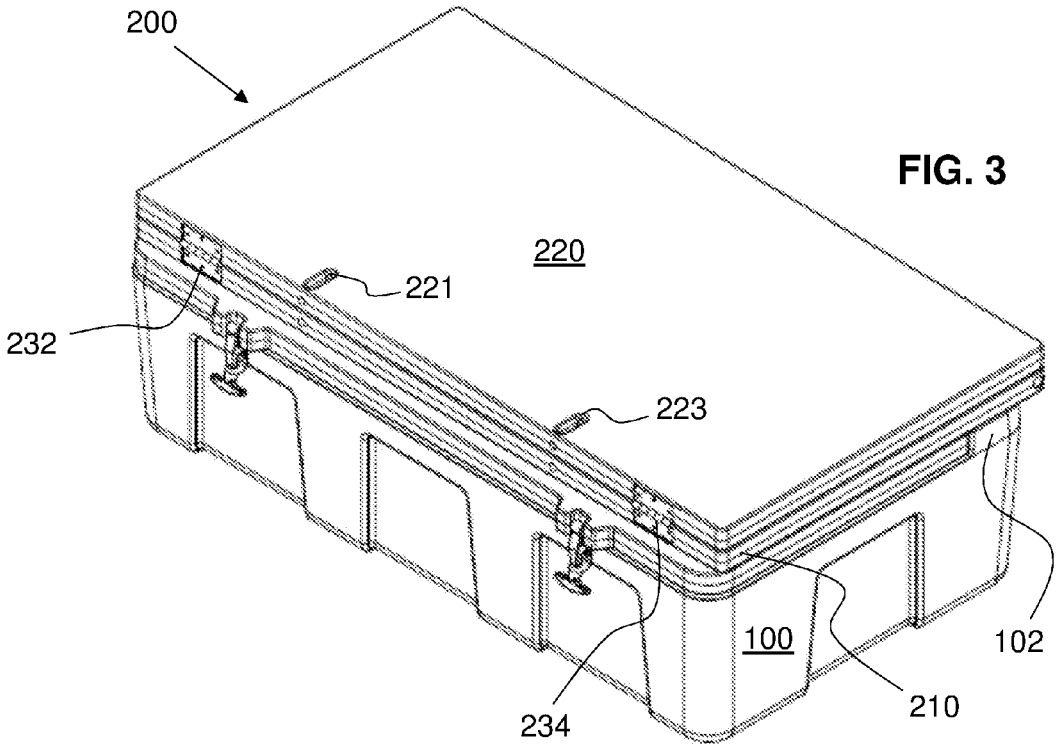
FIG. 3 is a perspective view of the cooler of FIG. 1 in a storage state with the bed extension folded upon a lid of the cooler in a storage position and with leg assemblies removed and not shown.

FIG. 3 depicts the bed extension 200 in a folded or stored orientation on top of the lid 102 of the cooler 100. As can be seen in this view, the hinge 230 between the adjoining panel 210 and the distal panel 220 is formed with two standard hinges 232, 234 but it can take any shape, including an folding material that can be integral with the two panels 210, 220 or fixed thereto. Also visible in this view is a bed extension lock 240, which will be described in further detail below.

Figure 6:
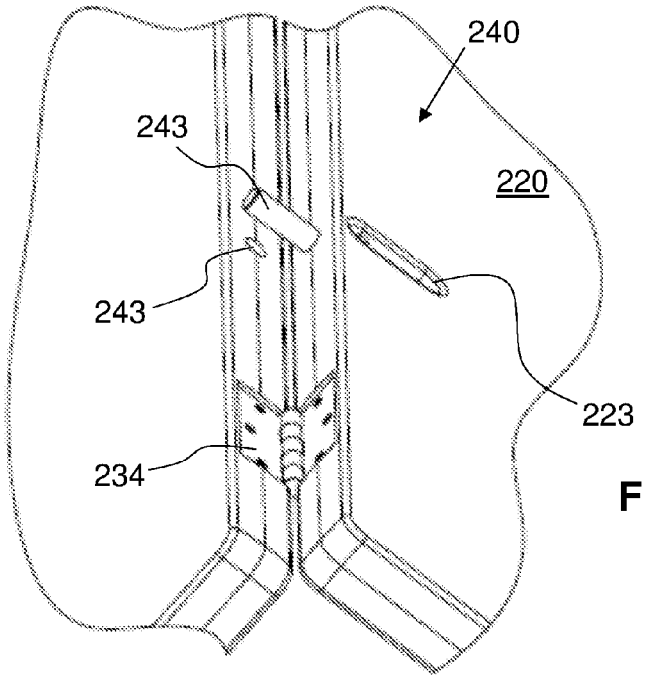
FIG. 6 is an enlarged, fragmentary, perspective view of a portion of a hinge of the bed extension of FIG. 6 in the intermediate opened position with one lock pin extended.
Figure 4:
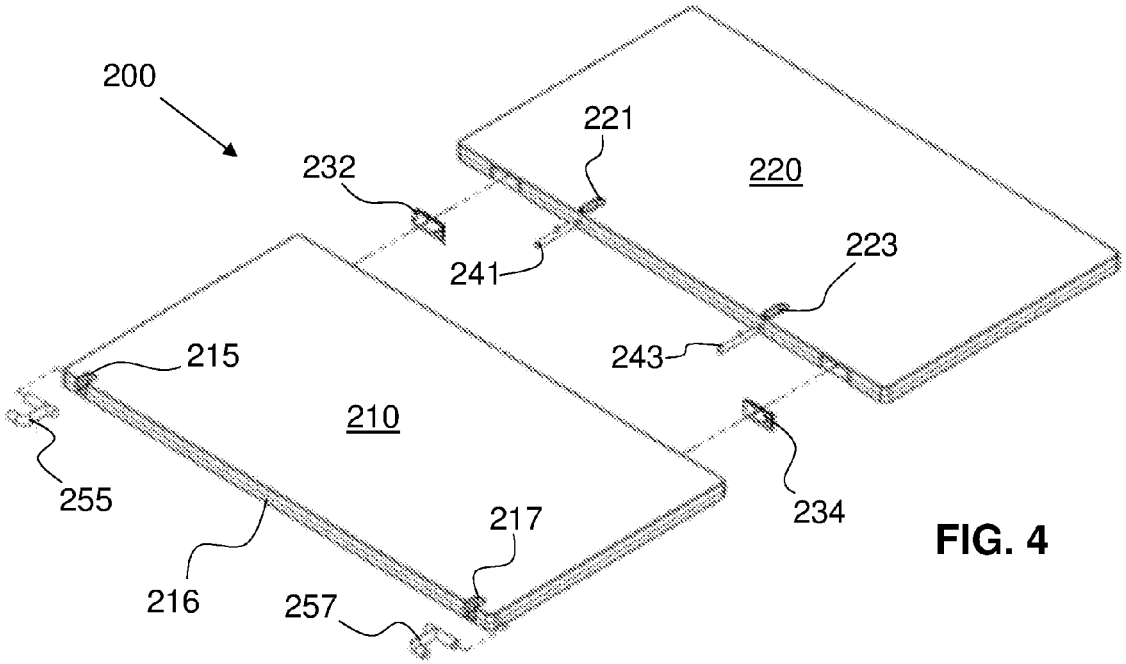
FIG. 4 is an exploded, perspective view of the bed extension of FIG. 1 with an adjoining panel, a distal panel, hook pins, hinges, and lock pins.
Figure 5:
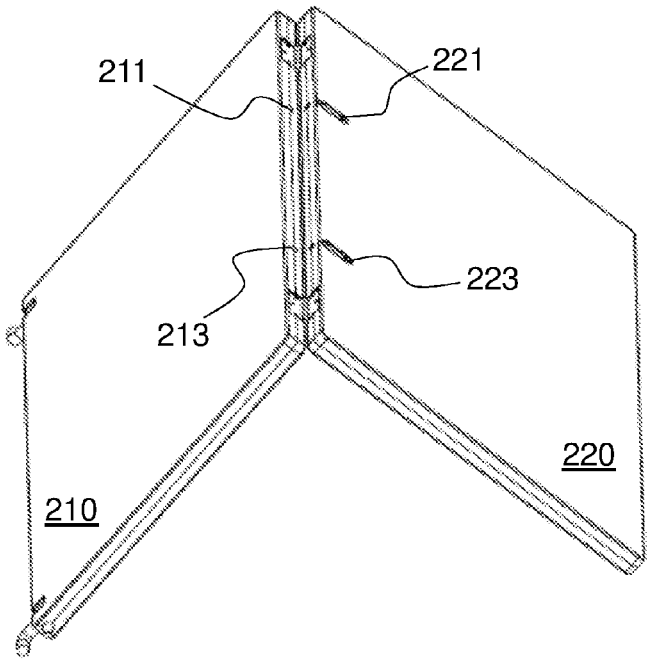
FIG. 5 is a perspective view of the bed extension of FIG. 1 in an intermediate opened position with lock pins retracted into the distal panel.
Figure 7:
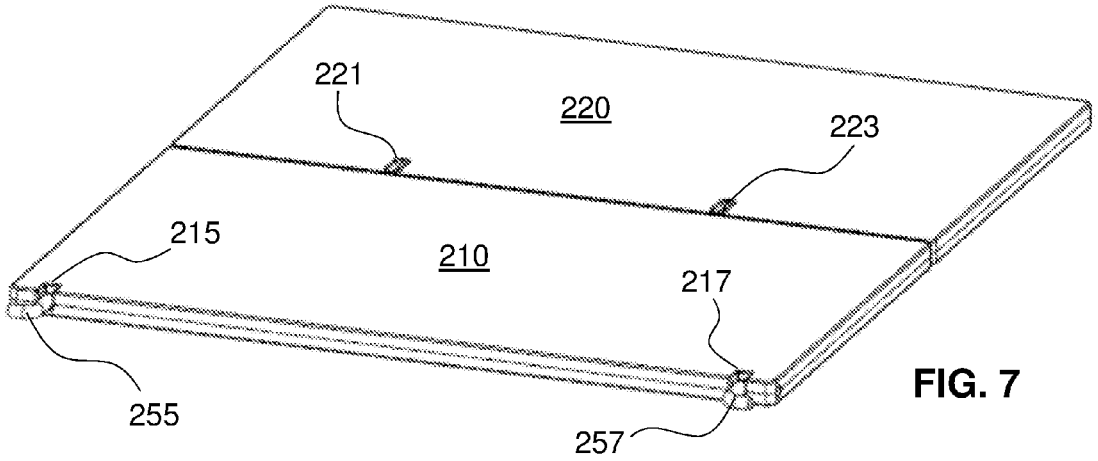
FIG. 7 is a perspective view of the bed extension of FIG. 1 in a locked open position and with the hook pins in the plane of the bed extension.

FIGS. 4 to 9 show various orientations of the bed extension 200. FIG. 4 illustrates the bed extension 200 in an exploded configuration. Here, lock slots 221, 223 are visible in the distal panel 220 and are shaped to slidably receive therein a respective lock pin 241, 243 of the bed extension lock 240. As best seen in FIG. 5, each of the lock pins 241, 243 slide out from the hinge edge of the distal panel 220 and into a respective pin hole 211, 213 of the adjoining panel 210. In this manner, when the bed extension 200 is in the open orientation shown in FIG. 2, the lock pins 241, 243 can be slid into the pin holes 211, 213 to provide support at the hinge 230 and prevent the hinge 230 from pivoting in any manner as the user places weight upon the sleeping surface 400. FIG. 5 shows the lock pins 241, 243 in a stowed orientation and the enlarged view of FIG. 6 shows the lock pin 243 in an extended orientation, where the panels 210, 220 are at an angle to one another with the hinge 234 in an intermediate open orientation. In the exemplary embodiment shown, there are two lock assemblies, 221-241-211, 223-243-213, but any number of lock assemblies can be provided. Further, this embodiment for a locking assembly that prevents the bed extension 200 from pivoting at the hinge 230 is only one possible example for keeping the bed extension 200 in a flat position until the user desires to bend the bed extension 200 at the hinge 230.

Figure 8:
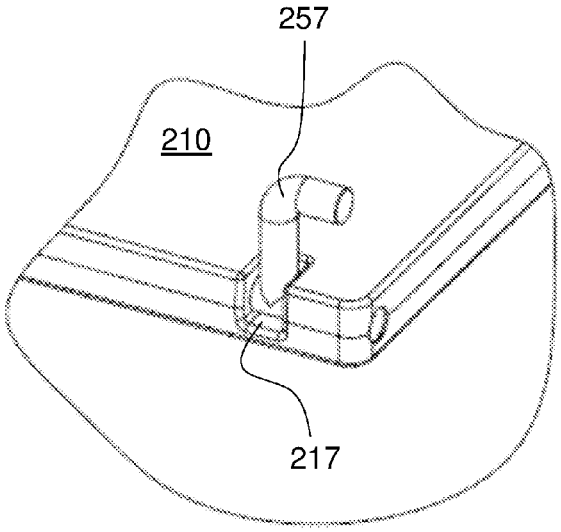
FIG. 8 is an enlarged, fragmentary, perspective view of a corner portion of the adjoining panel of the bed extension of FIG. 7 with one hook pin rotated out of the plane of the bed extension.

As explained above, removable leg assemblies 300 connect the distal end of the distal panel 220 to ground when assembled to support the distal panel 220 above the ground, as is shown in FIG. 2. To connect the opposite adjoining end of the bed extension 200 to the cooler 100 (for supporting the adjoining panel 210 above the ground), the adjoining panel 210 is provided with a set of internal hook retention slots 215, 217 each shaped to respectively accept a pivoting hook pin 255, 257. The lid 102 of the cooler 100 is also provided with upper hook slots 105, 107, each for a respective one of the hook pins 255, 257. FIGS. 1, 5, 7, and 9 to 11 show the hook pins 255, 257 in a horizontal, locking orientation and FIG. 8 shows the hook pins 255, 257 pivoted into an orientation at an angle to horizontal that, for example, would exist when the bed extension 200 is in the stowed configuration shown in FIG. 3.

Even though the adjoining edge 216 rests at a vertical side of the read edge of the lid 102 of the cooler, the shape of the hook slots 105, 107 and the hook pins 255, 257 prevent the adjoining panel 210 from moving away from the orientation shown in FIG. 2 when the hook pins 255, 257 are properly installed in the hook slots 105, 107. First, the distal hook portion of each hook pin 255, 257 prevents the adjoining panel 210 from moving parallel to the top surface 104 in the plane of the lid 102. Thus, the adjoining panel 210 is locked from moving away from the lid 102. Second, the lower interior surface of the hook slot 105, 107 prevents the lower surface of the hook pin 255, 257 from moving downwards, orthogonal to the top surface 104. Thus, the adjoining panel 210 is locked from moving below the lid 102. This secures the adjoining panel 210 with respect to the lid 102 in all three dimensions. In this exemplary embodiment, therefore, the hook pins 255, 257 and the hook slots 105, 107 for, together, a form-locking connection. A form-locking or form-fitting connection is one that connects two elements together due to the shape of the elements themselves, as opposed to a force-locking connection, which locks the elements together by force external to the elements.

Figure 8A:
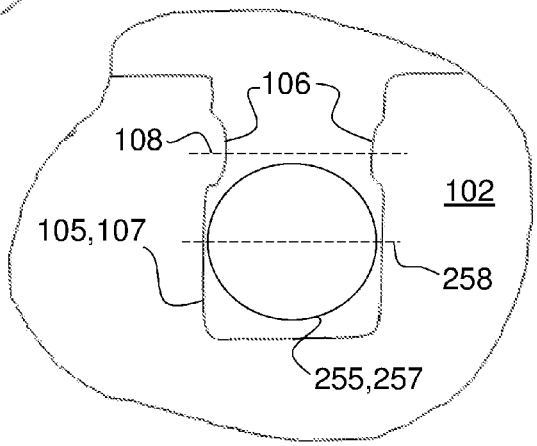
FIG. 8A is an enlarged, fragmentary, cross-sectional view along section line II-II in FIG. 2 of a hook pin inserted into a hook slot.

It is noted that lids of coolers are typically made of a plastic material having some flexing and elastically deformative properties. Accordingly, if the lid 102 is made of such materials, the interior of one or more of the hook slots 105, 107 can have an inwardly projecting boss 106 on either side of the channel or both sides (see, for example, FIG. 8A) and the channel can be deep enough so that the hook pins 255, 257, when fully seated within the channel of the hook slots 105, 107, can have a centerline 258 that is below the centerline 108 of the bosses. When such a configuration with bosses 106 is used, a resistance to entry in the hook slots 105, 107 is provided, where each hook pins 255, 257 must be pressed into the hook slots 105, 107 to move the opposing bosses 106 outwards just far enough to have the hook pin 255, 257 pass the centerline 108 of the bosses 106 and, after passing that centerline 108, the hook pin 255, 257 becomes removably captured between the lower surface of the hook slots 105, 107 on the bottom of the hook pin 255, 257, the side walls of the hook slots 105, 107 on the left and right sides of the hook pin 255, 257, and the bottom surfaces of the bosses 106 on the top side of the hook pin 255, 257. This, in essence, provides both a force-locking and form-locking connection between the hook pins 255, 257 and the hook slots 105, 107.

Figure 9:
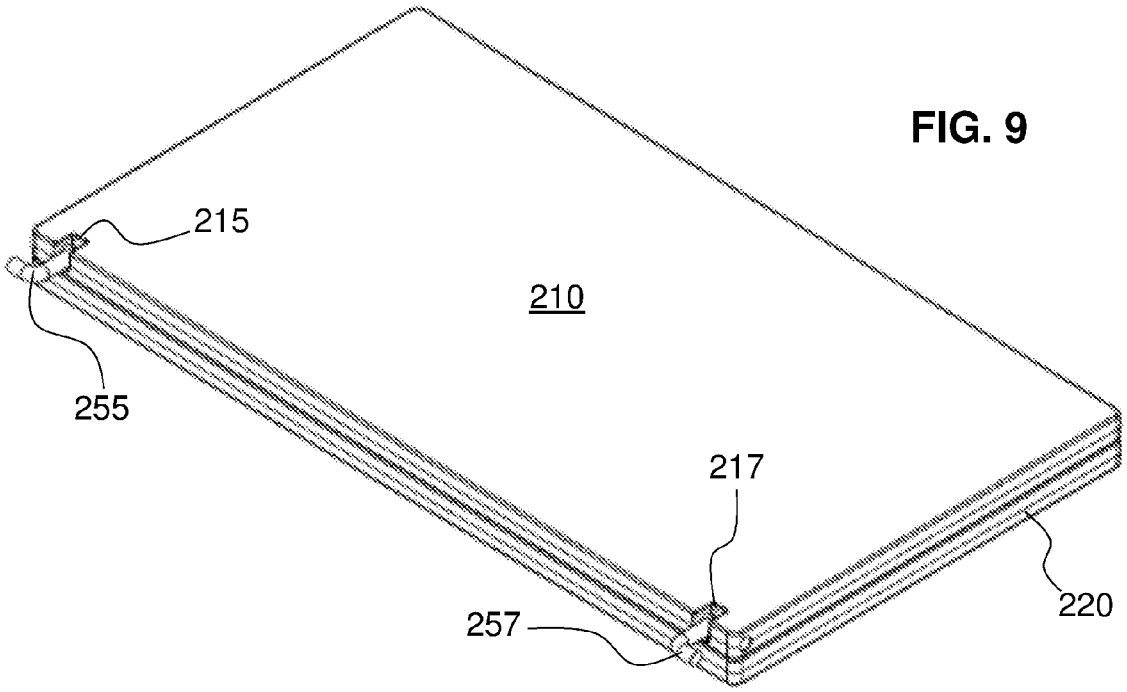
FIG. 9 is a perspective view of the bed extension of FIG. 7 in a folded, storage position with the hook pins parallel to the plane of the bed extension.
Figure 10:
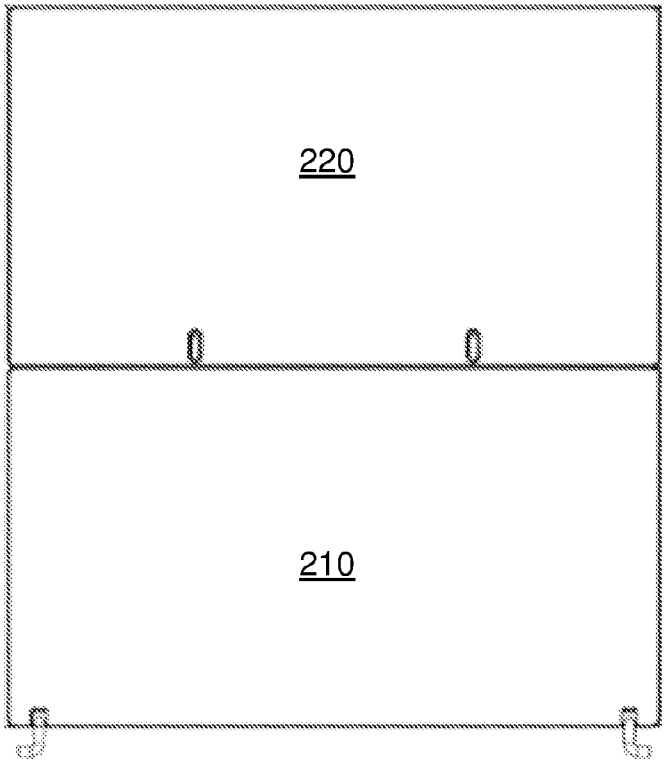
FIG. 10 is a top plan view of the bed extension of FIG. 7.
Figure 11:
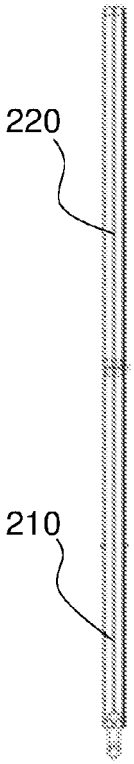
FIG. 11 is a side elevational view of the bed extension of FIG. 7.

One exemplary embodiment of the bed extension 200, shown in FIGS. 9 to 11, has a width of 47 inches (119.4 centimeters), a height of each panel 210, 220 of 25.95 inches (65.91 centimeters) (for a total of 51.90 inches (131.8 centimeters)), and a depth or thickness of 1.5 inches (3.81 centimeters).

Figure 12:
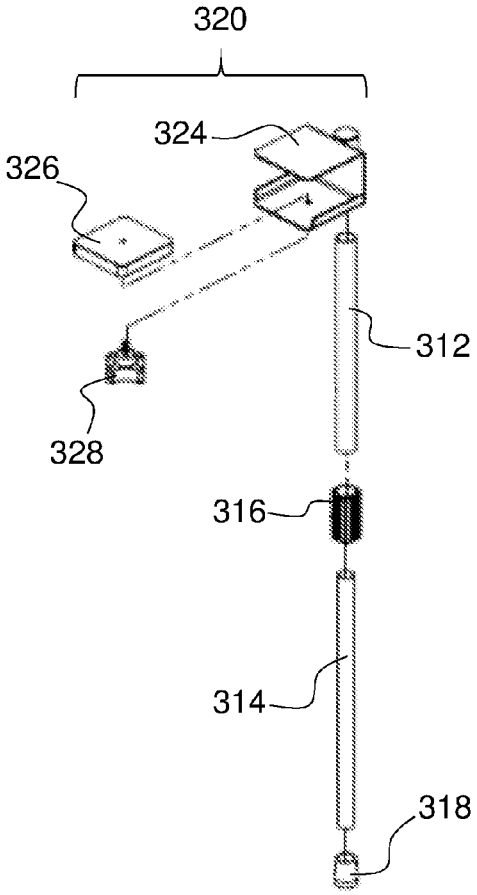
FIG. 12 is an exploded, perspective view of a leg assembly of FIG. 1.
Figure 13:
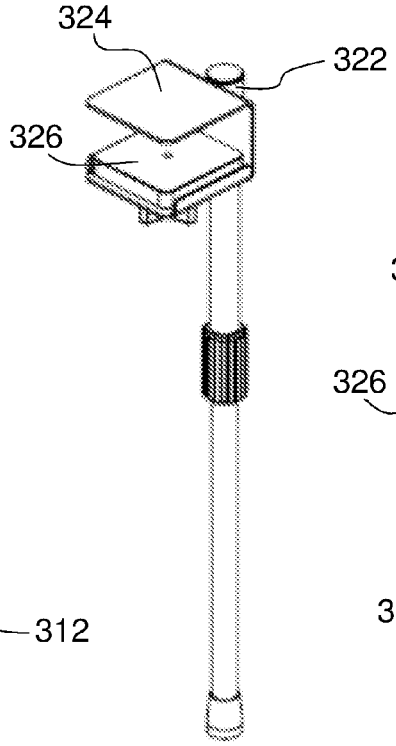
FIG. 13 is a perspective view of the leg assembly of FIG. 13.
Figure 14:
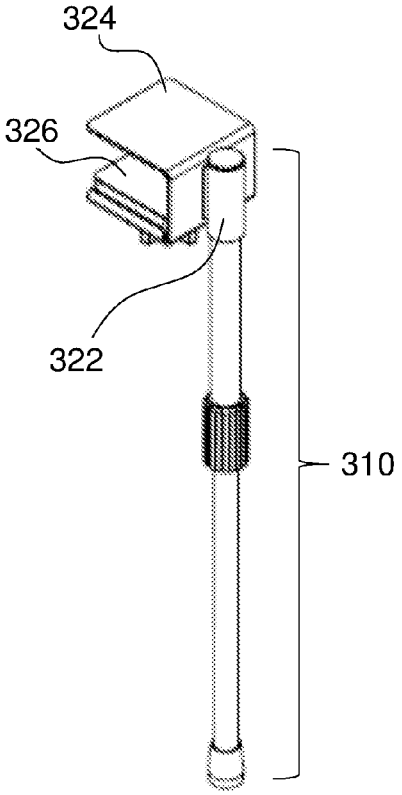
FIG. 14 is a perspective view of the leg assembly of FIG. 13 rotated ninety degrees clockwise.
Figure 19:
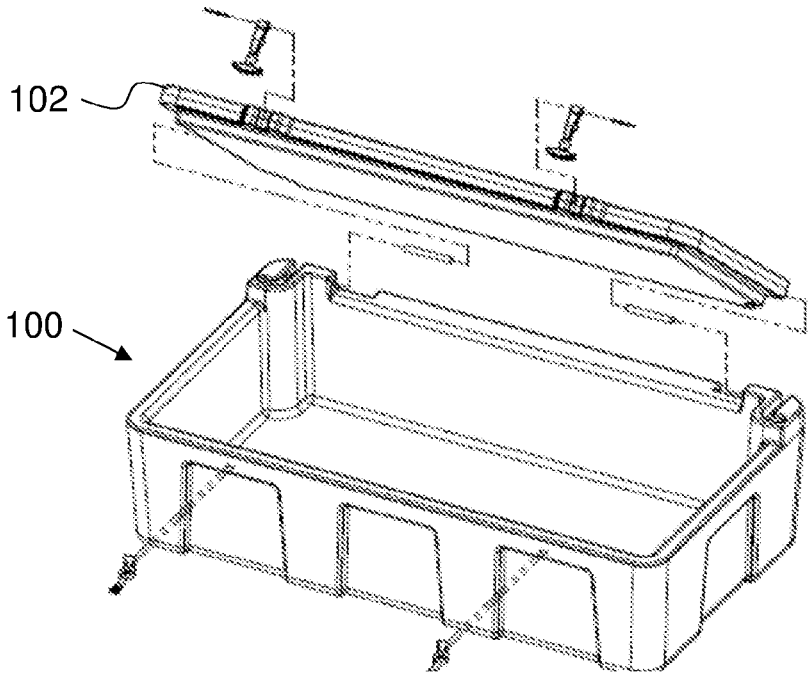
FIG. 19 is an exploded, perspective view of the cooler of FIG. 1 with body locks, a lid, lid pins, and lid locks.
Figure 20:
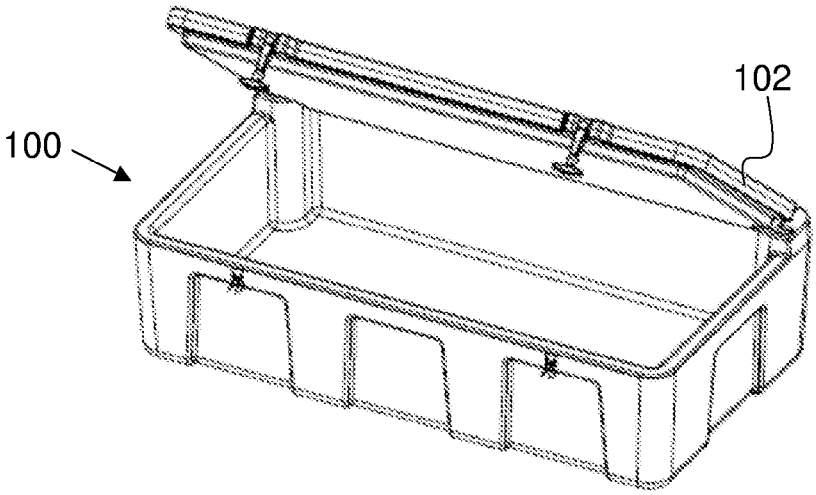
FIG. 20 is a perspective view of the cooler of FIG. 19 with the lid in an intermediate opened position.
Figure 21:
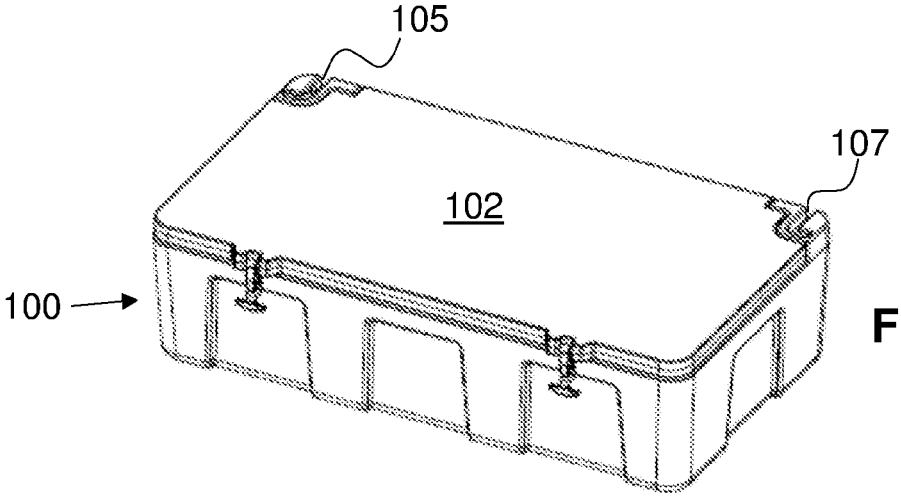
FIG. 21 is a perspective view of the cooler of FIG. 19 with the lid in a closed position.

FIGS. 12 to 14 illustrate an exemplary embodiment of a modular leg assembly 300. The leg assembly 300 comprises a telescoping leg 310 formed from an outer pole 312, an inner pole 314, a lock ring 316, and a foot 318. The inner pole 314 slides within the outer pole 312 and the lock ring 316 connects the two poles 312, 314 by fixing the relative distances when turned in one direction and allowing relative movement when rotated in the opposite direction. In an exemplary embodiment, the poles 312, 314 are of aluminum but they can be of any desirable material. The foot 318 is made from a material that prevents skidding along the ground, for example, rubber. An adjoining panel clamp 320 is connected fixedly to the top of one of the poles at a connector 322, which, in this exemplary embodiment, connects to the outer pole 314. The clamp 320 has an outer part 324 that surrounds the bed extension 200 (e.g., at the distal panel 220) and an internal adjustable clamp block 326 that, together with a screw 328, moves the top surface of the clamp block 326 with respect to the interior bottom surface of the top arm of the outer part 324 so that, when turned in one direction, the block 326 moves upwards and towards the top arm of the outer part 324 and, when turned in the opposite direction, the block 326 moves downwards and away from the top arm of the outer part 324.

In an exemplary embodiment, the block 326 can be approximately 0.5 inches (approximately 1.27 centimeters) in height and approximately 3 inches (approximately 7.62 centimeters) square and the top and bottom surfaces of the outer part 324 are also approximately 3 inches (approximately 7.62 centimeters) square. The top and bottom surfaces of the outer part 324 form a C-shape that is approximately 2 inches (approximately 5.08 centimeters) in height. The outer pole 312 can be about 0.75 inches (about 1.905 centimeters) in outer diameter and the inner pole 314 can be about 0.63 inches (about 1.6 centimeters) in outer diameter.

FIGS. 15 to 21 illustrate one exemplary embodiment of the cooler 100 with a lid 102 having connection areas 115, 117 with the hook slots 105, 107.

In an exemplary embodiment, the cooler 100 can be approximately 12 inches to 13 inches (30.48 to 33.02 centimeters) in total overall height and approximately 47 inches by 26 inches (119.4 by 66.04 centimeters) in footprint although it can have any other size.

It is noted that various individual features of the inventive processes and systems may be described only in one exemplary embodiment herein. The particular choice for description herein with regard to a single exemplary embodiment is not to be taken as a limitation that the particular feature is only applicable to the embodiment in which it is described. All features described herein are equally applicable to, additive, or interchangeable with any or all of the other exemplary embodiments described herein and in any combination or grouping or arrangement. In particular, use of a single reference numeral herein to illustrate, define, or describe a particular feature does not mean that the feature cannot be associated or equated to another feature in another drawing figure or description. Further, where two or more reference numerals are used in the figures or in the drawings, this should not be construed as being limited to only those embodiments or features, they are equally applicable to similar features or not a reference numeral is used or another reference numeral is omitted.

The foregoing description and accompanying drawings illustrate the principles, exemplary embodiments, and modes of operation of the systems and methods. However, the systems and methods should not be construed as being limited to the particular embodiments discussed above. Additional variations of the embodiments discussed above will be appreciated by those skilled in the art and the above-described embodiments should be regarded as illustrative rather than restrictive. Accordingly, it should be appreciated that variations to those embodiments can be made by those skilled in the art without departing from the scope of the systems and methods as defined by the following claims.

What is claimed is:

1. A convertible cooler with fold-out sleeping surface, comprising:

a cooler body having thermally insulating walls shaped to define an interior storage compartment with an upper opening and a rear wall having an upper rear portion;

a thermally insulated cooler lid pivotally connected to the upper rear portion such that, when closed upon the upper opening, the cooler lid substantially seals the upper opening from the environment so that items placed within the interior storage compartment are thermally insulated from the environment, the cooler lid having:

a top surface;

a rear side; and a lid connector disposed at the rear side and at the top surface of the cooler lid and the lid connector comprises a slot open at a portion of the rear side and at a portion of the top surface and extending from the rear side into a central portion of the cooler lid;

a bed extension having an adjoining edge, side edges, a distal edge, and a sleeping surface;

a bed extension connector pivotally connecting the adjoining edge of the bed extension to the cooler lid adjacent the rear side to rotate the bed extension between:

a stowed position, in which the bed extension rests flat upon the top surface of the cooler lid; and an extended position, in which the sleeping surface of the bed extension is substantially coplanar with the top surface of the cooler lid, the top surface of the cooler lid and the sleeping surface of the bed extension being sized to permit a person to sleep thereon; and at least one leg assembly connected to at least one of the side edges and the distal edge and adjustably supporting the distal edge of the bed extension above ground at a level that places the sleeping surface of the bed extension substantially coplanar with the top surface of the cooler lid when in the extended position.

2. The convertible cooler according to claim 1, wherein the lid connector comprises a hooked slot open at a portion of the rear side and at a portion of the top surface and extending orthogonally from the rear side along a first part into a central portion of the cooler lid for a given distance and then extending along a second part at an angle to the first part.

3. The convertible cooler according to claim 1, wherein the slot defines opposing bosses therein projecting into the slot.

4. The convertible cooler according to claim 2, wherein the bed extension connector comprises a hook pin shaped to mate with the hooked slot and, when mated therewith, removably securing the bed extension to the cooler lid.

5. The convertible cooler according to claim 1, wherein:

the bed extension comprises:

an adjoining panel having the adjoining edge and a first upper surface; and a distal panel pivotally connected to the adjoining panel and having the side edges, the distal edge, and a second upper surface; and the top surface of the cooler lid and the first and second upper surfaces together form the sleeping surface when the bed extension is moved into the extended position.

6. The convertible cooler according to claim 1, wherein the at least one leg assembly comprises:

a bracket configured to clamp upon the bed extension adjacent the distal edge and be removably connected thereto; and a telescoping leg connected to the bracket and telescopically movable to extend and retract away from and towards the bracket.

7. The convertible cooler according to claim 6, wherein the at least one leg assembly is two leg assemblies.

8. The convertible cooler according to claim 1, wherein:

the pivotable connection by the bed extension connector of the cooler lid to the adjoining edge of the bed extension is removable so that the bed extension may be selectively separated from the cooler lid by a user; and the at least one leg assembly is removably connected to at least one of the side edges and the distal edge so that the at least one leg assembly may be selectively separated from the bed extension by a user.

9. A convertible cooler with fold-out sleeping surface, comprising:

a cooler body having thermally insulating walls shaped to define an interior storage compartment with an upper opening and a rear wall having an upper rear portion;

a thermally insulated cooler lid pivotally connected to the upper rear portion such that, when closed upon the upper opening, the cooler lid substantially seals the upper opening from the environment so that items placed within the interior storage compartment are thermally insulated from the environment, the cooler lid having:

a top surface;

a rear side; and a lid connector disposed at the rear side and at the top surface of the cooler lid and the lid connector comprises a curved slot open at a portion of the rear side and at a portion of the top surface and extending orthogonally from the rear side along a first part into a central portion of the cooler lid for a given distance and then curving along a second part at an angle to the first part;

a bed extension having an adjoining edge, side edges, a distal edge, and a sleeping surface;

a bed extension connector pivotally connecting the adjoining edge of the bed extension to the cooler lid adjacent the rear side to rotate the bed extension between:

a stowed position, in which the bed extension rests flat upon the top surface of the cooler lid; and an extended position, in which the sleeping surface of the bed extension is substantially coplanar with the top surface of the cooler lid, the top surface of the cooler lid and the sleeping surface of the bed extension being sized to permit a person to sleep thereon; and at least one leg assembly connected to at least one of the side edges and the distal edge and adjustably supporting the distal edge of the bed extension above ground at a level that places the sleeping surface of the bed extension substantially coplanar with the top surface of the cooler lid when in the extended position.

10. The convertible cooler according to claim 9, wherein the bed extension connector comprises a hook pin shaped to mate with the curved slot and, when mated therewith, removably securing the bed extension to the cooler lid.

11. A convertible cooler with fold-out sleeping surface, comprising:

a thermally insulating cooler having:

an interior storage compartment; and a pivoting lid that, when closed, substantially seals the interior from the environment so that items placed within the interior storage compartment are thermally insulated from the environment, the lid having a top surface, a rear side, and a rear connector part, the rear connector part comprising a hooked slot open at the rear side and at the top surface and extending inwards from the rear side towards a central portion of the lid for a given distance and then extending at an angle thereto;

a bed extension having an adjoining edge, and a sleeping surface;

a bed extension connector pivotally connecting the adjoining edge of the bed extension to the rear connector part to rotate the bed extension between:

a stowed position, in which the bed extension rests flat upon the top surface of the lid; and an extended position, in which the sleeping surface of the bed extension is substantially coplanar with the top surface of the lid, the top surface of the lid and the sleeping surface of the bed extension being sized to permit a person to sleep thereon; and at least one leg assembly connected to the bed extension and adjustably supporting the bed extension above ground at a level that places the sleeping surface of the bed extension substantially coplanar with the top surface of the lid when in the extended position; and wherein the bed extension connector comprises a hook pin shaped to mate with the hooked slot and, when mated therewith, removably securing the bed extension to the lid.

12. The convertible cooler according to claim 11, wherein the hooked slot defines opposing bosses therein projecting into the hooked slot.

13. The convertible cooler according to claim 11, wherein:

the bed extension comprises:

an adjoining panel having the adjoining edge and a first upper surface; and a distal panel pivotally connected to the adjoining panel and having a second upper surface; and the top surface of the lid and the first and second upper surfaces together form the sleeping surface when the bed extension is moved into the extended position.

14. The convertible cooler according to claim 11, wherein the at least one leg assembly comprises:

a bracket configured to clamp upon the bed extension and be removably connected thereto; and a telescoping leg connected to the bracket and telescopically movable to extend and retract away from and towards the bracket.

15. The convertible cooler according to claim 11, wherein the at least one leg assembly is two leg assemblies.

16. The convertible cooler according to claim 11, wherein:

the pivotable connection by the bed extension connector of the lid to the adjoining edge of the bed extension is removable so that the bed extension may be selectively separated from the lid by a user; and the at least one leg assembly is removably connected to the bed extension so that the at least one leg assembly may be selectively separated from the bed extension by a user.

* * * * *